US006547191B2

(12) United States Patent
McDonald

(10) Patent No.: US 6,547,191 B2
(45) Date of Patent: Apr. 15, 2003

(54) DOCKSIDE LINE AND CABLE HOLDER

(75) Inventor: Kenneth A. McDonald, Sacramento, CA (US)

(73) Assignee: Innovative Marine Products, Inc., San Ysidro, CA (US)

( * ) Notice: Subject to any disclaimer, the term of this patent is extended or adjusted under 35 U.S.C. 154(b) by 0 days.

(21) Appl. No.: 09/766,870

(22) Filed: Jan. 18, 2001

(65) Prior Publication Data

US 2002/0130223 A1 Sep. 19, 2002

(51) Int. Cl.[7] ..... F16L 3/21
(52) U.S. Cl. ..... 248/49; 248/70; 248/624
(58) Field of Search ..... 248/65, 69, 70, 248/74.1, 576, 578, 605, 624

(56) References Cited

U.S. PATENT DOCUMENTS

| | | | | | |
|---|---|---|---|---|---|
| 75,306 | A | * | 3/1868 | Smith | 248/624 |
| 2,733,033 | A | * | 1/1956 | Gunderson | 248/51 |
| 2,978,217 | A | * | 4/1961 | Gunderson | 248/75 |
| 2,984,445 | A | * | 5/1961 | Dobrikin | 248/75 |
| 3,646,696 | A | * | 3/1972 | Sarkisian | 40/602 |
| 3,835,486 | A | * | 9/1974 | Benoit et al. | 5/317 R |
| 3,862,410 | A | * | 1/1975 | Maxwell | 362/186 |
| 3,999,776 | A | * | 12/1976 | Betts, Sr. | 280/851 |
| 4,069,995 | A | * | 1/1978 | Miller | 248/118.1 |
| 6,267,336 | B1 | * | 7/2001 | Ruckstadter | 248/118.3 |

* cited by examiner

*Primary Examiner*—Leslie A. Braun
*Assistant Examiner*—Deborah M. Brann
(74) *Attorney, Agent, or Firm*—Mark C. Jacobs

(57) ABSTRACT

An apparatus for the temporary stowage of cables and lines which emanate from a docked vessel for obtaining power, cable TV and telephone reception, which apparatus may be permanently or temporarily mounted to a substrate such as a marina's decking. The apparatus includes a base to which is attached at least one and preferably up to four spaced springs, each of which is also mounted to an upper plate, from which a preferably flexible shaft extends in an upwardly direction. Mounted on the shaft is at least one cable and line receiving means for retaining the cables and lines therein. Cables for TV, telephone, and lines for fresh water and perhaps fuel can be stowed on the apparatus pending and during connections to such utilities.

23 Claims, 5 Drawing Sheets

DOCKSIDE LINE AND CABLE HOLDER

This invention pertains to an apparatus to be affixed either temporarily or permanently to a dock for receipt of a ship's electrical cable, water line, and other lines such that dock side power, television, and water sources among others can be accessed while the cables and lines are neatly retained during periods of connection to the sources of electricity, water and the T.V. cable.

BACKGROUND OF THE INVENTION

When a boat moors at a dock, for an extended period of time, it does so often not just to reload provisions, such as foodstuffs, containerized beverages, and naval stores, but also to obtain fresh water, and fuel the tank. Today's boat lovers have luxuries on board not available in yesteryear. Mention may be made of electricity, cable television, water and telephones not associated with ship to shore radio. When a boat is moored, the cables pertaining to the provision of cable TV, electrical power, and the hoses or lines for water or phone are all attached to a dockside vessel support system to continue the delivery of these utilities to the vessel. Other utilities that employ either an electrical cable or a flexible hose, may be employed for the delivery of other ship needed items as well.

Normally these lines and cables are retained on shipboard in a coiled up fashion. No doubt the reader has seen rope coiled up on a ship's deck waiting to be thrown to a person who might fall overboard, or a downed water skier. The cables are kept coiled in like manner.

Should the cables and hoses be left un-retained in a neat fashion, one or more of them could fall into the water, and perhaps cause an outage, or at least corrosion of the line which could interfere with satisfactory delivery of the TV or phone signal or of power for use on shipboard. As an alternative, injury could take place to passers-by walking near or even on cables and lines that may be laying around haphazard on the dock.

When these cables and/or hoses (lines) are handed over in some fashion to docking personnel, if the cables and lines are left on their own, they can become tangled up and sometimes one or more of them can fall in the water, often creating a retrieval problem. On the other hand, if the cables and lines are merely piled on the dock helter-skelter, there is always the possibility of injury to passers-by, which could create a liability problem for the shipowner.

While apparatuses for the stowage and support of cables and lines are known to the art none are portable such that they can be moved from location to location as the ship travels the seven seas.

Thus reference can be made to the following U.S. patents which turned up during the course of a search:

| | | |
|---|---|---|
| Blair | 5,167,388 | Issued Dec. 1, 1992 |
| Korson | 5,909,861 | Jun. 8, 1999 |
| Dvorachek | 4,238,096 | Dec. 9, 1980 |
| Gunderson | 2,978,217 | Apr. 4, 1961 |

None of the above mentioned patents either alone or in combination discloses the invention set forth herein and which is the subject matter of the appended claims.

The invention accordingly comprises the device possessing the features properties and the relation of components which are exemplified in the following detailed disclosure and the scope of the application of which will be indicated in the appended claims.

SUMMARY OF THE INVENTION

Figure 2:
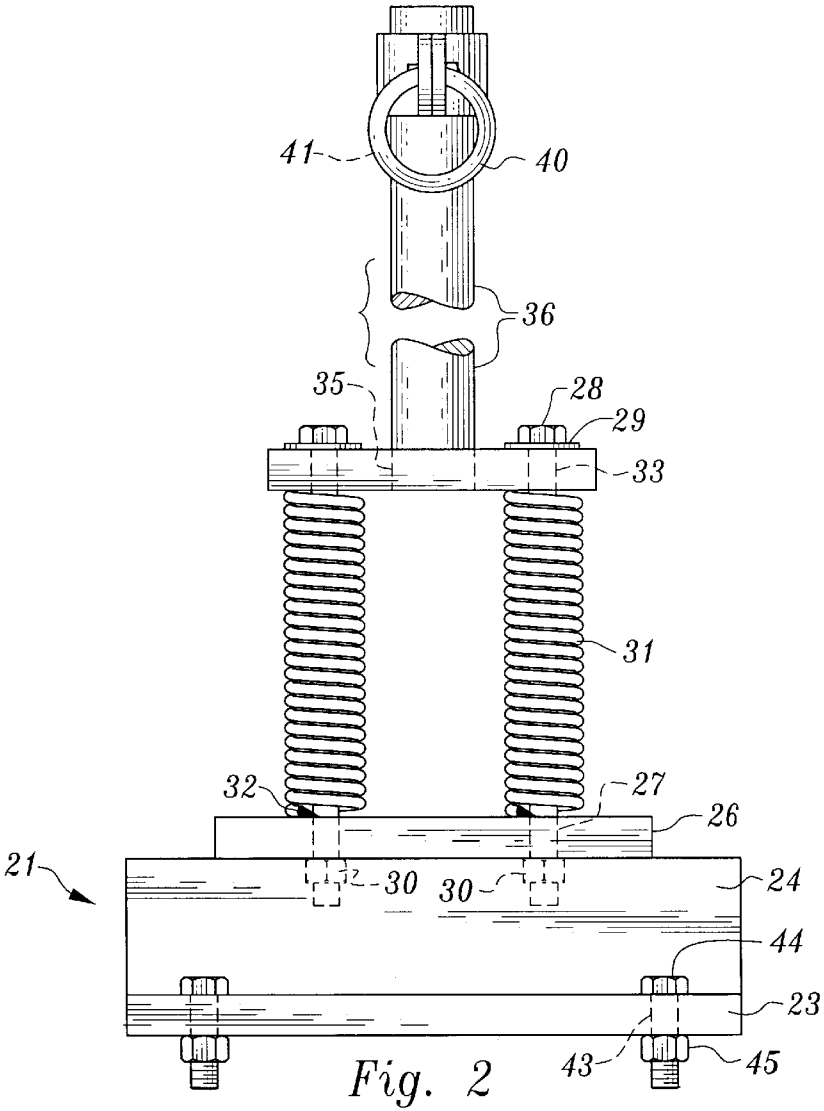
FIG. 2 is a right side elevational view of the dock line and cable holder of this invention.

The invention of this application pertains to an easy to use apparatus that may be mounted temporarily or permanently to a substrate such as wood, concrete, fiberglass or metal substrates decking at a public or private marina, and which in the alternative may also be moved from location to location if owned by the ship owner as may be desired.

The apparatus of this invention includes a base to which is attached a spring mounted upper plate. A flexible mast protrudes upwardly from the base, and has attached to it, at least one cable and line receiving means. The apparatus can be temporarily mounted or permanently mounted to a marina's decking.

This invention permits the lines and cables of a vessel to be stowed during periods of mooring, such that the cables and lines are maintained in an orderly fashion.

It is a first object of this invention to provide a dock mountable portable, if desired, stowage apparatus for a ship's cables and lines.

It is a second object to provide a cable and hose stowage apparatus that includes a flexible portion and as such is capable of moving with the tide and/or the wind, and as such will retain the cables and lines during ship movement.

It is a third object to provide a spring loaded apparatus for the temporary stowage of a vessel's cables and hoses and to keep the cables and hoses out of the water.

It is a fourth object to provide a cable stowage apparatus that can be mounted either permanently or short term to dock surfaces of various constructions.

Other objects of the invention will in part be obvious and will in part appear hereinafter.

The apparatus of this invention is seen to include a base for attachment either short term or long term to the surface of the dock. A spring mounted platform is disposed above the base, to permit the platform a certain amount of freedom of movement. An upstanding flexible pole centrally mounted to the platform, has at least one cable and hose retaining means attached at its distal end, the end distant from the mounted end. The retaining means may be split ring(s), U-shaped members, snap rings and the like, all of which will retain the cables and hoses out of the way and out of the water, during the times these cables and lines are connected to utility sources on the dock.

For a fuller understanding of the nature and objects of the invention reference should be made to the following detailed description, taken in conjunction with the accompanying drawings.

DESCRIPTION OF THE PREFERRED EMBODIMENT

The invention of this application is made up of 5 main components several of which have more than one embodiment or variants. As seen from the ground up, they are the base 15, the spring section 16, the platform 17, the pole 18 and the cable & line retainer portion 19. See FIG. 1.

Figure 1:
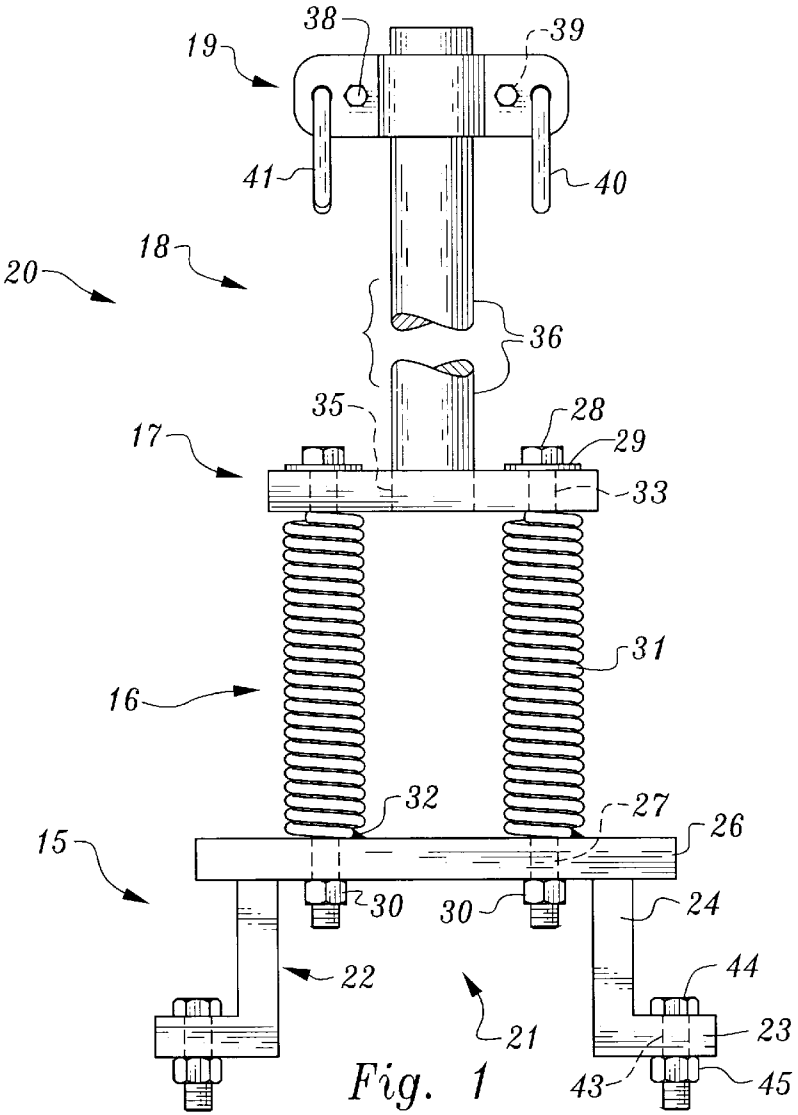
FIG. 1 is a front elevational view of a first embodiment of this invention. The rear view is a mirror image thereof.

In FIG. 1, a first embodiment 20 of this invention is seen. The base portion 15 of this embodiment is designated 21. Base 21 includes a pair of spaced opposed L-shaped legs, 22, each consisting of a horizontal section 23 and a vertical section 24. The horizontal section of each of which 23 is mounted to the underside of a plate, designated lower plate 26. While shown mounted spaced inwardly from the outer edges of plate 26, legs 22, may also be mounted at the outer edges of said plate 26. The horizontal section 23, of legs 22, include a vertical through bore 43 for the receipt of a mounting bolt 44, which in turn is adapted to pass through the decking of a dock, to be retained in place by bolt 45. See also FIG. 2 for the location of horizontal section 23. Base plate 26 has a plurality of through bores 27 equal to the number of springs to be mounted, which in this embodiment is 4.

Spaced from the plate 26 is the platform 17 which in this embodiment includes upper plate 34. A series of threaded bolts 28, each having a washer 29 thereon passes through a bore 33 in plate 34 as well as through the bores 27 for securement by nuts 30. Threaded bores 27 are spatially aligned with bores 33 such that the disposition of plate 34 relative to plate 26 is one of parallelism.

A coil spring is disposed on each bolt and urges the platform 34 upwardly, such to retain this plate 34 in a spaced relationship with base plate 26. Adjacent the distal end of each bolt at the upper surface of the base plate 26, the lower end of a coil spring is welded to the plate, as denoted by weld point 32. The bolt however is not welded to the plate.

Disposed upon each bolt 28 intermediate the plates 34 and 26 is a coil spring. As will be discussed infra in detail, each coil spring may be any of a barrel spring, a pyramidal spring or a cylindrical spring. Presently each spring will just be referred to a spring. Thus each spring 31 is welded into place at location 32 on the lower plate 26 adjacent the respective bore 27 for the pin 28 disposed through the respective spring. The springs may optionally be welded to the underside of the upper plate 34. See FIGS. 1 and 2. The upper plate and the lower plate as well as the L-shaped legs may each be made of metal such as painted steel or anodized aluminum or of a suitable molded plastic such as nylon. Base 21 may also be formed as one piece if desired.

A flexible rod 36 having an upper end and a lower end, of such material as stainless steel, graphite, Kevlar® material, or fibreglass, is fixedly mounted at its lower end in a bore 35 centrally located in plate 34. This mounting may be by having the rod threaded into position, glued, welded or otherwise secured as may be appropriate for the material employed for both the rod and the upper plate 34. Again see FIGS. 1 and 2.

Disposed at the upper end of the rod 36 is a clamp 38 having at least one and as seen here, a pair of cable and line receiving means 39, such as a ring 40, or split ring 41, each of which has an opening 40 through which the various cables and hoses may pass for temporary retention.

Figure 4:
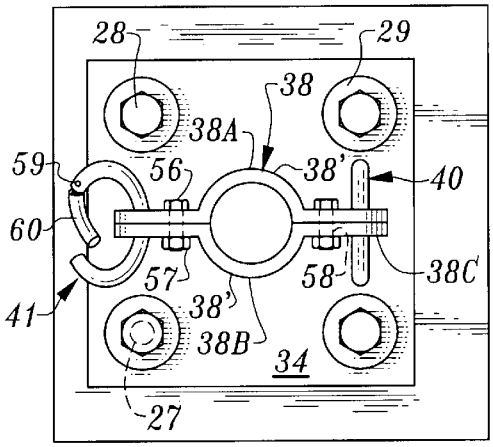
FIG. 4 is a top plan view of part of this invention.
Figure 6:
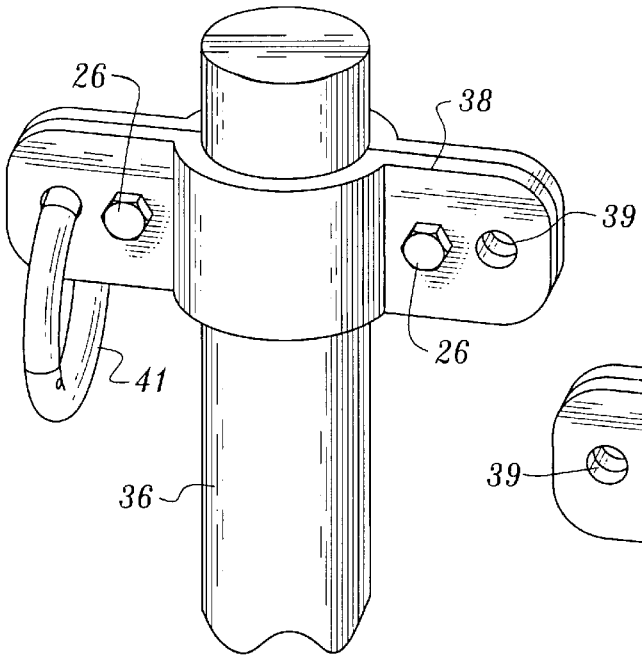
FIG. 6 is a perspective view of the upper portion of this invention.

Details of one type of clamp may be found in FIG. 4 to which reference is now made. Here the clamp 38 is seen to be formed of two mirror image portions 38' each of which comprises an opposed hemispherical section, 38A and 38B, each of which hemispherical sections has a pair of oppositely extending wings 38C. The pairs of wings are tightly joined by a bolt 57 which passes through a bore 58 and which bolt is secured by a nut 56.

Other means such as friction fit, and the use of a suitable adhesive are contemplated to attach this clamp or any other suitable clamp to the flexible rod.

See in closeup in FIG. 4 is a split ring 41. These are readily available in the marketplace and include a main portion 59 and a spring loaded inwardly moveable section 60. FIG. 4 also illustrates the bolt 28 with washer 29 that passes through bore 27 at four locations on plate 34.

Figure 3:
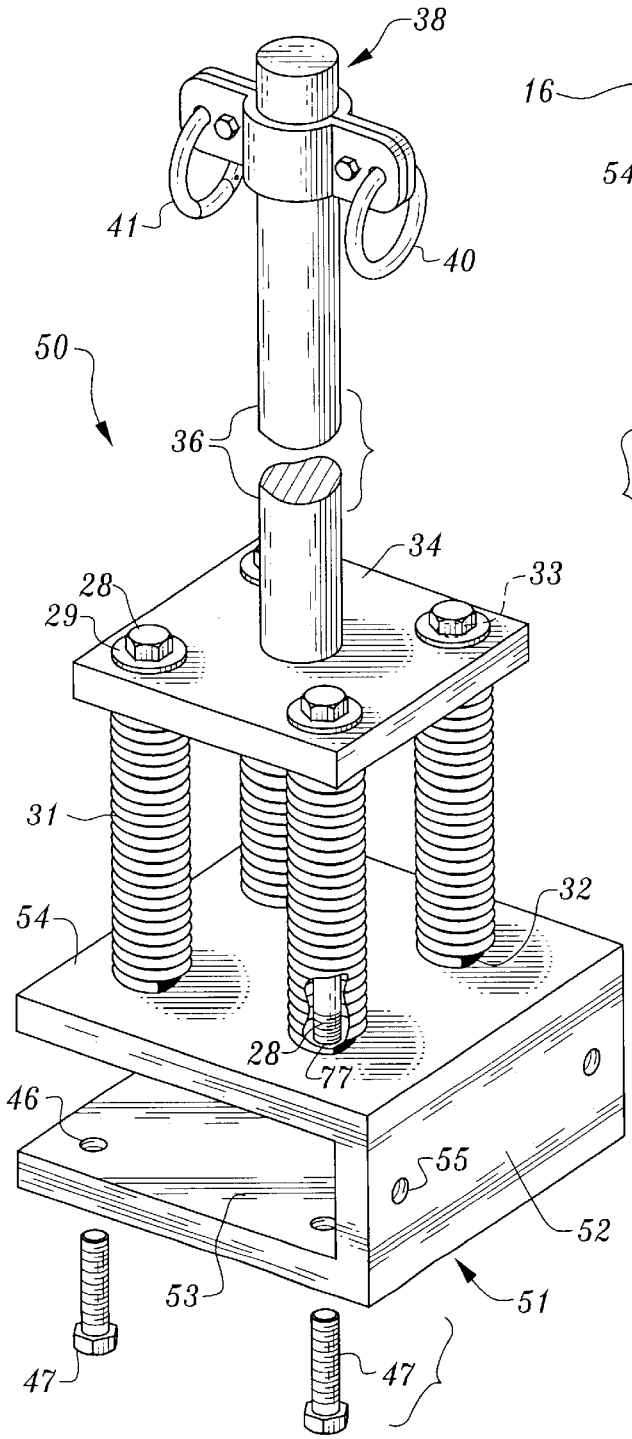
FIG. 3 is a perspective view of a second embodiment thereof.

The discussion now turns to the second embodiment 50 seen in FIG. 3. Most aspects of this embodiment are the same as discussed with respect to the first embodiment. Therefore where appropriate like numbers represent like parts and such will merit little further discussion.

The second embodiment does include a different base, namely a C-shaped base 51.

This base 51 includes a vertically disposed rectangular plate section 52 connected at its upper and lower ends to a pair of equi-dimensional horizontally disposed rectangular plate sections 53, 54. Located adjacent each corner of the bottom of the two horizontal plates, 53 is a threaded through bore 46. For receipt of a bolt 47. Plate 52 may also include a pair or more of spaced side bores 55 also for mounting of the base 51 as may be desired.

Figure 5:
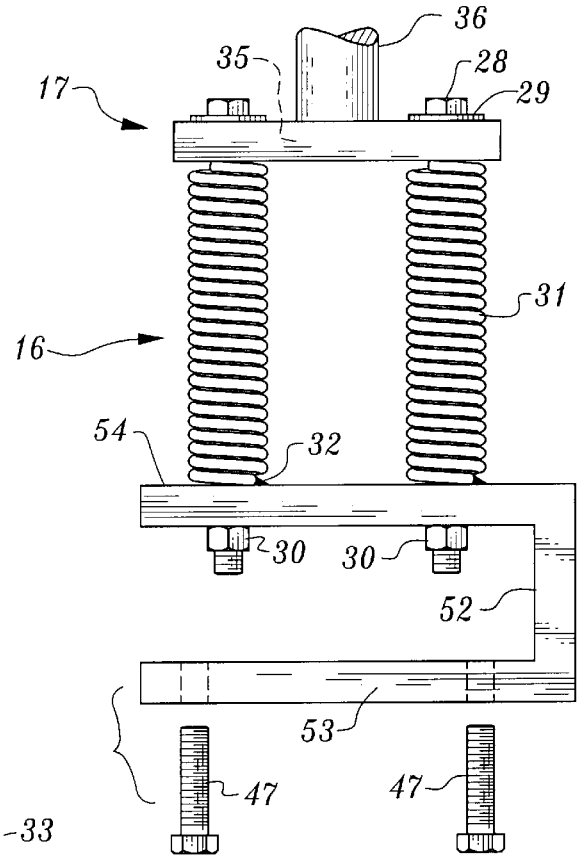
FIG. 5 is a side elevational of the base portion of the first embodiment.

In order to have consistent nomenclature, it is noted that the plate 54 of the base 51 while in an upper position is designated the lower plate, since the springs are attached upwardly therefrom. It, 54, has four bores 77 in spatial alignment with the threaded bores 33 of the upper plate. Thus the same mount means for the 4 coil springs 31 using threaded bolts 28 disposed through a washer 29 and the respective bore 33 of upper plate 34, down into bores 77 by a nut 30 as per FIG. 5 can be carried out. The springs may be welded into place at location 31, also as seen in closeup in FIG. 5.

Figure 7:
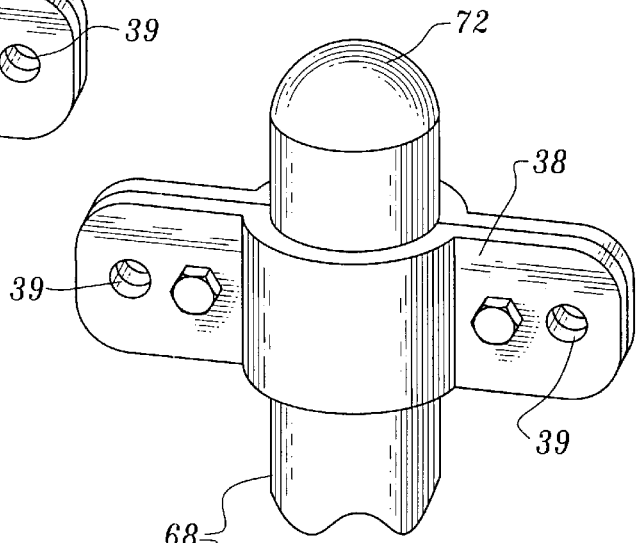
FIG. 7 is a perspective view of a variant of the upper portion of this invention.
Figure 7:
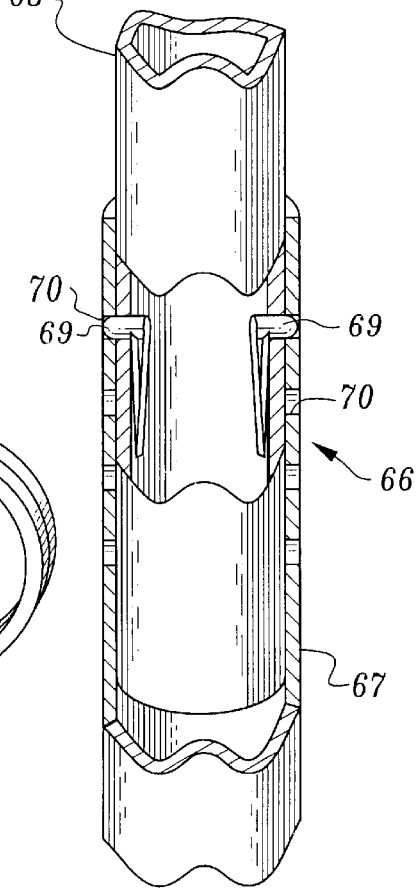

The mast 36 may be the same as previously discussed, or may further include a nose 72 for both cosmetic and aerodynamic purposes as shown in FIG. 7. The clamp for this embodiment may be clamp 38 or any other suitable clamp which includes cable and line retention means. Note that in FIG. 3, one split ring 41 and one standard ring 40 are employed as the cable and line receiving means.

In FIG. 7, a telescoping rod 66 is seen. It may be made of the same material as rod 36 or of other materials suitable for such purpose. Upper section 68 is seen to nest into lower section 67 and when extended is retained in position by a pair of conventional spring loaded buttons 69 which are releasably engageable to bores 70 of the outer section 67. Such extension and retraction telescopic disposition means are found in camera tripod legs and are deemed conventional. In FIG. 7 the same clamp 38 as previously disclosed may be employed.

Figure 8:
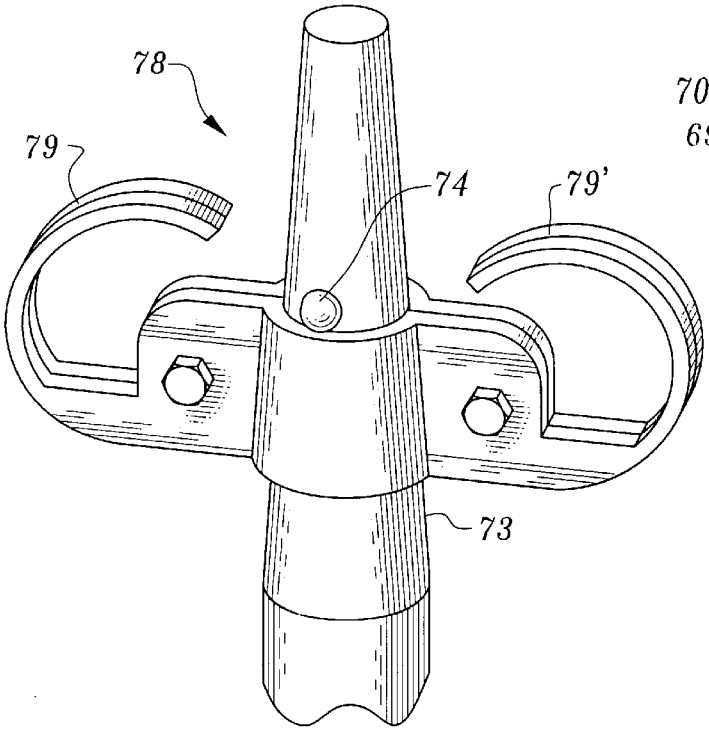
FIG. 8 is a cutaway view of a variant of the upper portion of this invention.

In FIG. 8, an alternate configuration for the rod, now designated 73 is seen. This rod 73 is tapered rather than being of uniform cross section. Here a tapered opening clamp 78 having a cross section at the top of the opening smaller than the cross section at the bottom of the opening is employed. A screw or applied boss 74 keeps clamp 78 from rising upwardly off the rod 73. Clamp 78 may also be adhesed into place. This clamp also includes two cable and line receiving means 79 and 79', one of which is a mere ring, the other of which is a split ring as previously described. These are, however, integral and fixed into and form part of the clamp 78.

Figure 9:
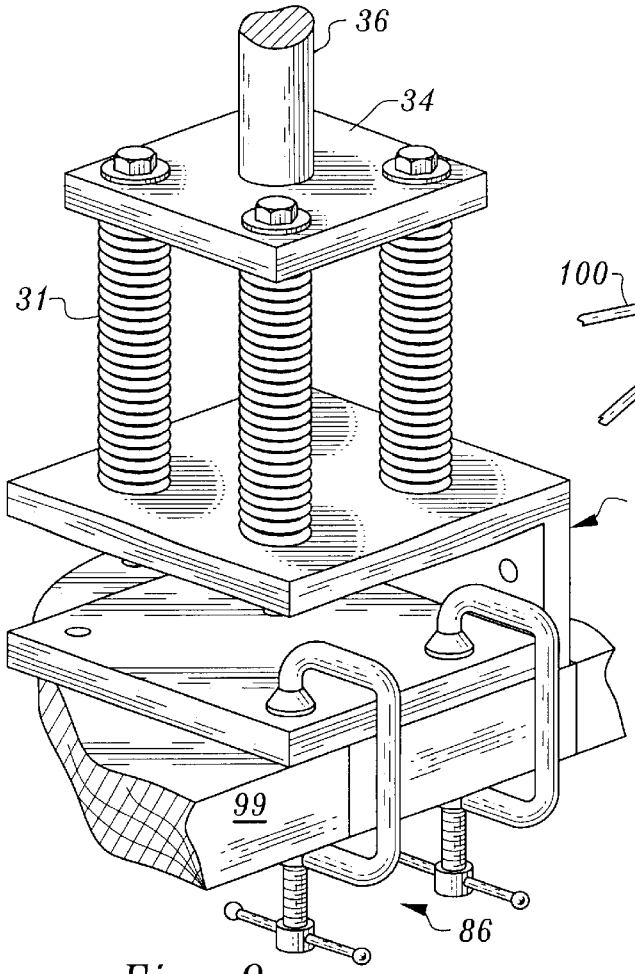
FIG. 9 illustrates one mode of temporary mounting of this invention for use.

FIG. 9 illustrates a mode of temporary mounting of the apparatus of this invention to the wooden decking 99 of a marina. Thus a pair of conventional C-clamps 86 can hold the base 15 such as C base 51 to the decking.

Figure 10:
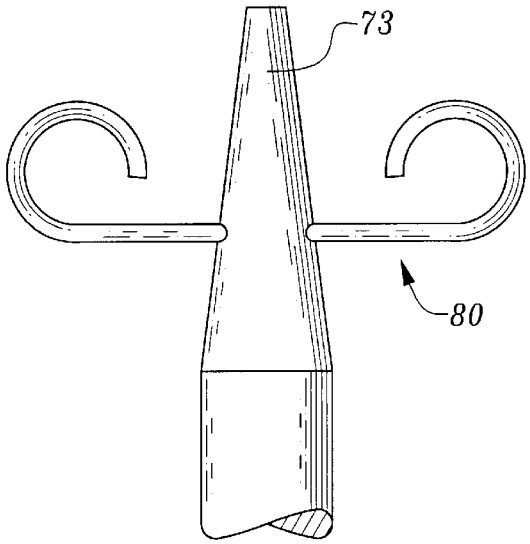
FIG. 10 is perspective view of a variant of a line and cable retention means of this invention.

It is also to be seen that the cable and line receiving means need not be of a ring configuration. A shape such as a cup hook 80 upon which the cables and lines may rest may also be employed. These may be attached directly to the rod, as shown in FIG. 10 as by threaded engagement or welding, or gluing as may be appropriate; or indirectly attached as part of a clamp.

Figure 11:
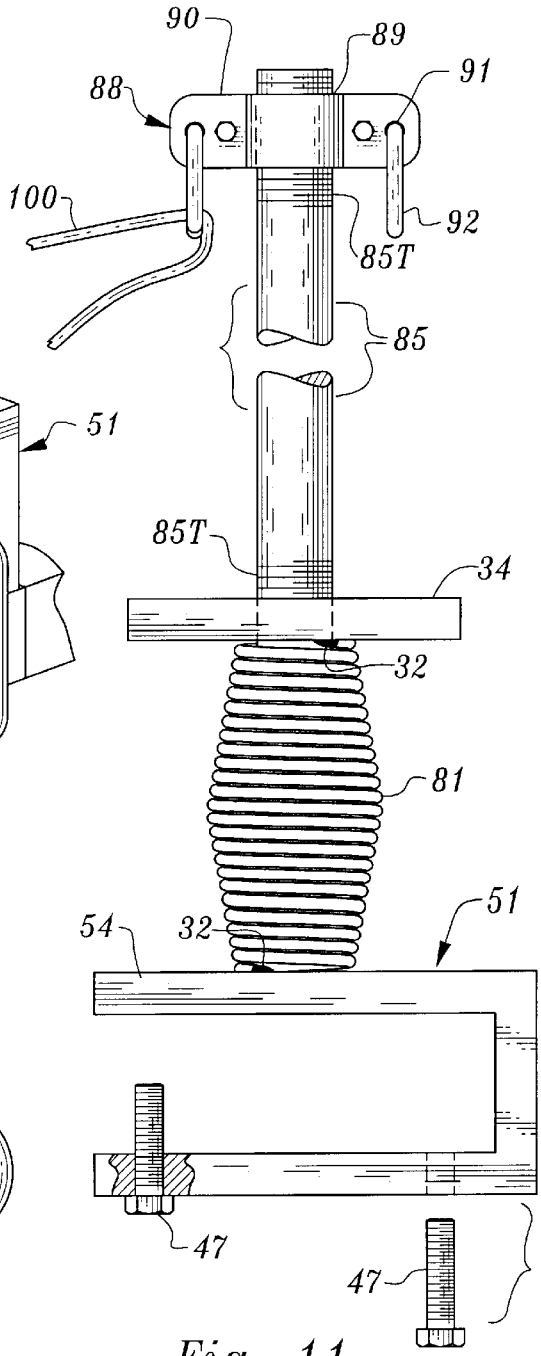
FIG. 11 is an elevational view of an alternate version of the first embodiment.

The discussion now moves to FIG. 11. Here a C-shaped clamp 51 is seen to be in position for mounting onto a dock surface such as 2×6" boards using mounting bolts 47. In this embodiment however, rather than use 4 springs, a single barrel shaped spring is employed. Barrel coil spring 81 is welded at weld point 32 to the upper section of the C-shaped base 51, and to the plate 34 constituting the platform. A central unseen threaded bore in plate 34 receives the lower threaded end 85T of a flexible shaft 85 therein. Shaft 85 also has a threaded end at its upwardly disposed end, for engagement in the female threaded central section 89 of bracket 88. A pair of opposed wings 90 emanate from the central section 89, each of which has a horizontal throughbore 91, and each of which through bores 91 carries a spring loaded clip ring 92. A typical cable or line is seen disposed through said clip ring 92.

Figure 12:
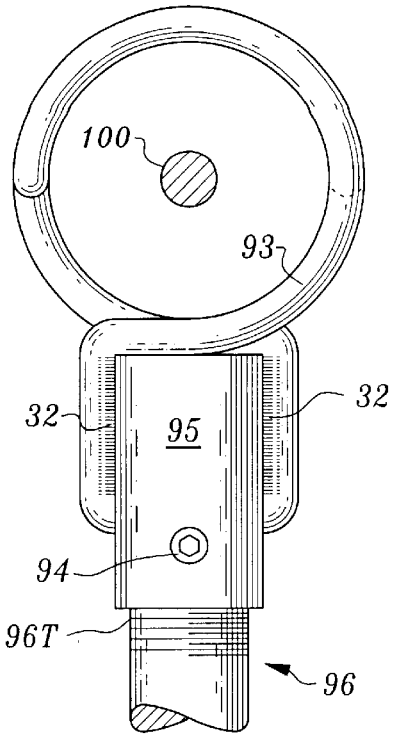
FIG. 12 and FIG. 13 are side elevational views of several different cable and line retaining devices.

In FIG. 12, a metal cap is seen to be threadedly engaged to an optionally tapered flexible fibreglass shaft 96. A circular threaded cap 95, is threadedly engaged to the threads 96T of said shaft 96. An Allen screw, 94 ensures a tight engagement to the threads 96T. A pair of opposed linearly spaced open rings are welded at weld points 32 to the cap 95. The openings of said open rings face in opposite directions and as such cables and lines can either be passed through the openings from one end, such as is illustrated by the disposition of cable 100. A cable can also be dropped down between the rings and then rotated 90 degrees to be retained within the spaced opposed open rings 93.

Figure 13:
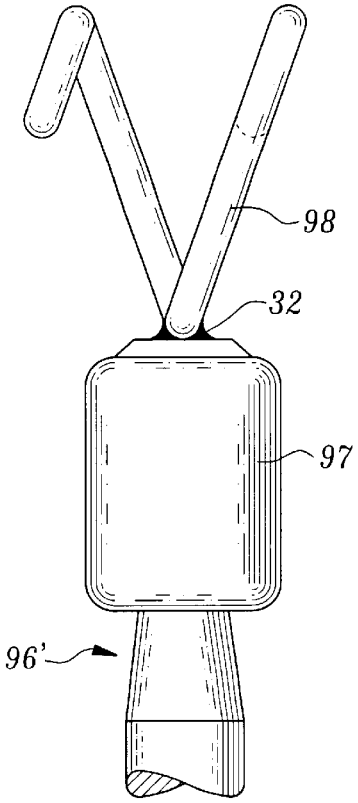

In FIG. 13 a tapered flexible rod 96'—to differentiate it from the non-threaded shaft of FIG. 12—is seen to have a metal cap 97 glued or otherwise attached thereto. A single open loop ring 98 with an upwardly positioned opening is welded thereto for retention of cables and lines.

Figure 14:
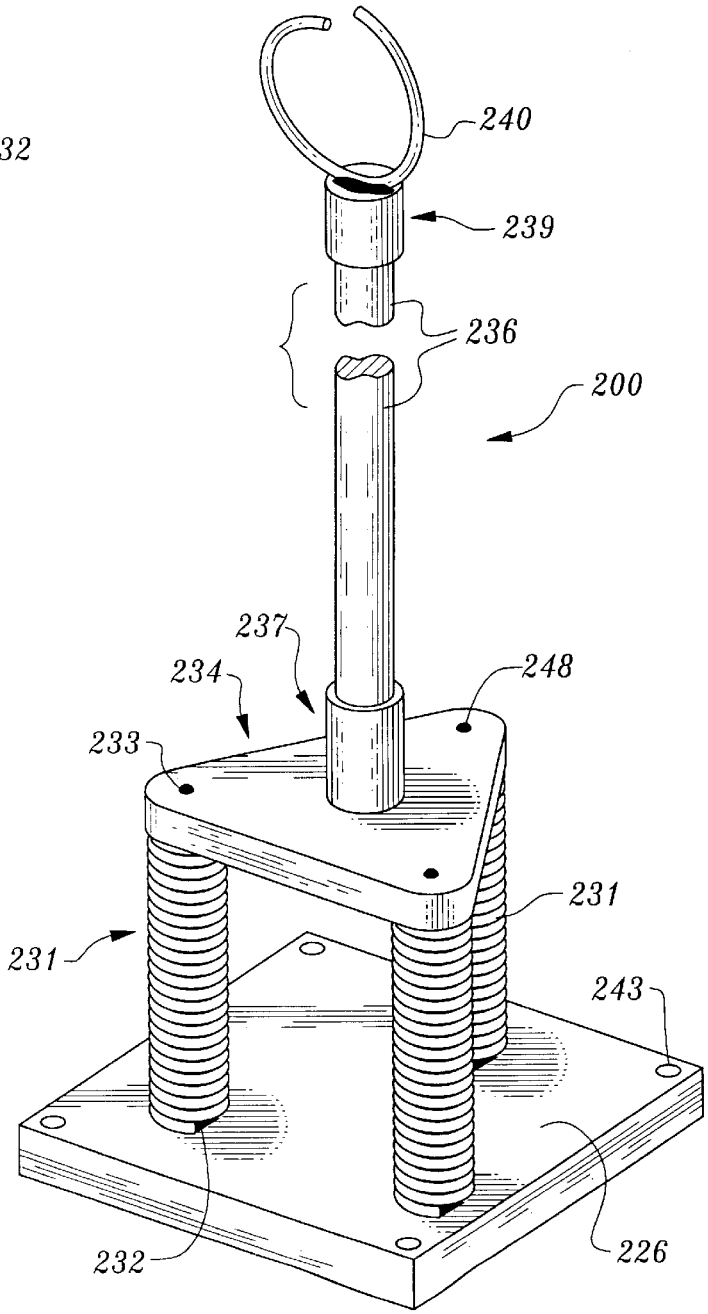
FIG. 14 is a perspective view of a lower cost embodiment of this invention, shown without a base.

In FIG. 14 there is shown a lower cost version of this invention suitable primarily for smaller vessels in the 20 to 50 feet or so in length. This embodiment 200 has a lower base 226 of a rectangular configuration, similar to base 26 and is made preferably of stainless steel, though galvanized steel or even polycarbonate plastic may be employed. Typical dimensions for lower base 226 are 6 inches×6 inches. Base plate 226 includes mounting bores 243 adjacent each corner, through which bolts may be placed for attachment to a wood deck. A trio of springs 231, which may be either of the barrel type configuration, discussed previously or standard cylindrical coil springs, are welded in place, upright, at their lower ends in a triangular configuration to lower base 226 at weld points 232. The upper ends of these 3 springs may be placed through a trio of bores 233 for securement as by welding at weld points 248 or such spring may have a cap nut or other fastener attached thereto for retention. A suitable spring for this embodiment 200, would be a 3" long, 1" in diameter, close wound stainless steel coil spring.

Disposed upright in the center of the equilateral triangular upper plate 234 is a tubular shaft holder 237. This too is preferably made of stainless steel and is welded into position in an upright disposition. Shaft 236's lower end is friction fit into the shaft holder 237, by the use of close tolerances for the two elements, as is readily understood.

Ring mount 239 comprising a tubular member is crimped at one end and welded to conventional split ring 240 at that end. The open end of the ring mount 239 is friction fit onto shaft 236's upper end. Shaft 236 is preferably made of fibreglass, while the split ring and its mount 239 are preferably stainless steel due to exposure to water and in some instances salt. This single split ring serves as the cable and line receiving means of this embodiment.

While shown as being of uniform thickness, such as ⅝ inch in thickness, a tapered shaft may be employed equally well.

Conclusion

When a ship drops anchor or pulls along side the deck of a marina, the lines and cables are dropped from the ship, and placed in the apparatus of this invention's cable and line receiver means, for ultimate connection to sources of water, telephone, cable TV and the like which all have stubs located nearby for easy connection. Use of the apparatus of this invention, keeps the lines and cables out of the water to avoid possible interruptions of service, and helps avoid accidents by keeping them handy but out of the way. By having the upstanding rod range from about 3 feet to 8 feet tall, either fixedly or adjustably, the longest of lines and cables can be accommodated.

As noted supra, any of three different configurations may be employed, cylindrical, barrel, or pyramidal. A cylindrical spring, would provide uniform flex all thought the coils, and could cause the mast or rod to bend too much such that its tip might touch the ground which could cause the retained lines or hoses to come loose from the retainment. A pyramidal spring, is easier to flex at the beginning and as the flex continues, the spring becomes stiffer, due to the greater diameter of the coil at the bottom thereof. The barrel shape in one sense is the preferred shape spring to be employed with this invention, because its section of maximum resistance is in the middle rather than at the bottom, and as such it keeps the rod more upright after any initial flex, but the cost per spring is higher. The conical spring is the least costly.

When employing either type of base, one can attach the apparatus permanently using bolts that go through a substrate and the base. In the alternative bolts may be used for a temporary disposition, in that they may not pass through the substrate deck, but may only be tightened to provide a friction fit, thus making the apparatus portable. The use of a pair of "C" clamps accomplishes the same desired result of portability for the C base unit. Indeed on some substrates, oppositely facing hook and loop closures may be adhesively attached to the substrate and to the underside of the base for temporary mounting.

By having the upper plate spring mounted, and the upstanding rod, flexible, it is seen that movement of the vessel due to tides, high winds or even personnel movement on smaller vessels will have little or no effect upon the retention capability of the apparatus for the cables and lines, prior to and during any extended hookup period, while the vessel is moored. By providing for means for the temporary disposition of the apparatus, boat captains can be certain that their lines and cables are not damaged even when docking at the crudest of facilities, as they can take the cable and line holder of this invention with them from port to port, slip to slip.

A non-tapered rod is seen to be preferred to a rod or shaft that is of a tapered width, as excess flexibility is obtained from the utter. Fibreglass forms the best flexible shaft. If ABS, or PVC is used for non-flexible shafts, all flex would be limited to the movement of the springs, and none to the shaft itself, which could result in a cracking of the shaft. In the last discussed embodiment, the base may be truly triangular or the corners can be chamfered for both aesthetic and safety reasons.

Since certain changes may be made in the described apparatus without departing from the scope of the invention herein involved, it is intended that all matter contained in the above description and shown in the accompanying drawings shall be interpreted as illustrative and not in a limiting sense.

I claim:

1. An apparatus for temporary stowage of cables and lines which emanate from a docked vessel for making connections to dock side utilities, which apparatus comprises:

[a] a base, having a lower plate, which base is adapted for mounting to a dock's substrate,

[b] an upper plate, having been spring mounted at a first end to said upper plate and mounted at a second end to said lower plate,

[c] an upstanding shaft fixedly secured to the top surface of said upper plate, and

[d] means comprising cable and line receiving means mounted on said shaft for temporary receipt and retention of cables and lines.

2. The apparatus of claim 1 wherein the base comprises a pair of opposed L-shaped legs attached on the underside of said lower plate.

3. The apparatus of claim 2 wherein the legs of said base includes throughbores for the receipt of fasteners.

4. The apparatus of claim 1 wherein the base is C-shaped, and the lower plate consists of the upper one of the parallel legs of the C.

5. The apparatus of claim 1 wherein the upper plate is spring mounted to the lower plate by 4 coil springs arranged in a rectangle.

6. The apparatus of claim 2 wherein the coil springs are barrel shaped.

7. The apparatus of claim 2 wherein the coil springs are cylindrical.

8. The apparatus of claim 1 wherein the upper plate is spring mounted to the lower plate by a trio of springs arranged in a triangle.

9. The apparatus of claim 8 wherein the upper plate is generally triangular.

10. The apparatus of claim 8 wherein the springs are cylindrical coil springs.

11. The apparatus of claim 1 wherein the upstanding shaft is flexible.

12. The apparatus of claim 1 wherein the upstanding shaft is rigid.

13. The apparatus of claim 11 wherein the shaft is tapered, the narrower end being at the top.

14. The apparatus of claim 1 wherein the means comprising cable and line receiving means mounted on said shaft is a clamp having at least one ring attached thereto.

15. The apparatus of claim 14 wherein the clamp has a pair of split rings attached thereto.

16. The apparatus of claim 12 wherein the upstanding shaft consists of a plurality of telescoping sections.

17. The apparatus of claim 1 wherein the end of the shaft distant from the upper plate has a threaded end.

18. The apparatus of claim 17 wherein the means comprising cable and line receiving means mounted on said shaft is a threadedly engaged threaded cap having a pair of spaced opposed open rings attached thereto.

19. The apparatus of claim 17 wherein the means comprising cable and line receiving means mounted on said shaft is a threadedly engaged threaded cap having a single open ring attached thereto in an upwardly disposition.

20. The apparatus of claim 1 wherein the base consists essentially of the lower plate.

21. The apparatus of claim 20 wherein the upper plate is spring mounted to the lower plate by a trio of springs arranged in a triangle.

22. The apparatus of claim 21 wherein the upper plate is generally triangular.

23. An apparatus for temporary stowage of cables and lines which emanate from a docked vessel for making connections to dock side utilities, which apparatus comprises:

[a] a base, consisting essentially of a lower plate, which base is adapted for mounting to a dock's substrate,

[b] a triangular upper plate, spring mounted to said lower plate by a trio of coil springs,

[c] an upstanding shaft disposed upwardly from the top surface of said upper plate, and

[d] means comprising cable and line receiving means mounted on said shaft, which means comprises a cap disposed on the end of the shaft distant from said upper plate, said cap having at least one open ring thereon for temporary receipt and retention of cables and lines.

* * * * *